US005125629A

United States Patent [19]

Nishimura

[11] Patent Number: 5,125,629

[45] Date of Patent: Jun. 30, 1992

[54] HAND-OPERATED CHAIN BLOCK

[75] Inventor: Yosaku Nishimura, Hirakata, Japan

[73] Assignee: Vital Kogyo Kabushiki Kaisha, Osaka, Japan

[21] Appl. No.: 574,610

[22] Filed: Aug. 29, 1990

[51] Int. Cl.[5] ..... B66D 3/16

[52] U.S. Cl. ..... 254/358; 254/372

[58] Field of Search ..... 254/372, 358; 474/140, 474/144

[56] References Cited

U.S. PATENT DOCUMENTS

| | | | |
|---|---|---|---|
| 126,391 | 5/1872 | Hall et al. | 254/403 |
| 349,520 | 9/1886 | Samuel | 474/140 |
| 385,856 | 7/1888 | Hambay | 254/343 |
| 428,675 | 5/1890 | Holt | 474/140 |
| 577,330 | 2/1897 | Speidel | 254/358 |
| 2,503,682 | 4/1950 | Parker | 254/372 |
| 2,637,525 | 5/1953 | Lock | 254/269 |
| 3,030,076 | 4/1962 | Stevens | 254/358 |
| 3,894,720 | 7/1975 | Koji | 254/372 |
| 4,221,364 | 9/1980 | Nishimura | 254/338 |
| 4,792,323 | 12/1988 | Flaig | 474/144 |
| 4,881,720 | 11/1989 | Nishimura | 254/358 |
| 5,007,617 | 4/1991 | Nishimura | 254/372 |

FOREIGN PATENT DOCUMENTS

| | | |
|---|---|---|
| 48-19725 | 6/1973 | Japan . |
| 49-36204 | 10/1974 | Japan . |
| 8205 | of 1893 | United Kingdom . |

*Primary Examiner*—Katherine Matecki

[57] ABSTRACT

A hand-operated chain block which is lightweight and simplified in the structure of the hand chain wheel portion, and safe and smooth in the hand chain operation is provided with a hand chain wheel cover for covering the upper, lower and front parts of the hand chain wheel, and a hand chain guide cover for covering the sides of the hand chain wheel such that the entire circumference of the hand chain wheel is covered. The hand chain guide cover is a one-piece body folded and formed from one metal plate, comprising drooping parts for guiding the UP side and DOWN side of the hand chain, and a bottom part for coupling the lower ends of the drooping parts. Upper support parts are formed in the upper end portions of the drooping parts and are inserted and supported on the upper stays, and a lower support part formed in the middle of the bottom part of the hand chain guide cover is positioned and supported on the lower stay. The hand chain wound on the hand chain wheel is inserted and guided in the hand chain inserting holes formed in the side portions of the bottom part of the hand chain guide cover.

5 Claims, 3 Drawing Sheets

HAND-OPERATED CHAIN BLOCK

BACKGROUND OF THE INVENTION

1. Field of the Invention

The present invention relates to a hand-operated chain block, and more particularly to a hand-operated chain block which is lightweight and simple in construction with respect to the hand chain wheel portion, and which permits safe and smooth hand chain operation.

2. Description of the Prior Art

Conventionally, in the structure of the hand chain wheel portion of a hand-operated chain block, safety measures for operation of the hand chain are provided, and various lightweight and simplified structures for reducing the weight of the entire chain block have been proposed.

The present inventors have proposed structures as disclosed, for example, in Japanese Utility Model Publications No. 48-19725 and No. 49-36204.

In the chain block disclosed in the Japanese Utility Model Publication No. 48-19725, a positioning dowel is formed in the hand chain guide plate, a small hole is formed in the hand chain wheel cover, and the hand chain guide plate is designed to be fixed on the chain block by engagement of a stay for hand chain wheel cover mounting and engagement of the dowel and with the small hole. The guide portion of the hand chain guide plate projects so as to cover an upper edge portion of a side window of the hand chain wheel cover.

On the other hand, the chain block disclosed in the Japanese Utility Model Publication No. 49-36204 has the hand chain cover having a split-type construction, consisting of an upper cover having a hook section so as to cover the front upward outer portion of the hand chain wheel, and a U-shaped lower cover that covers the front outer part of the hand chain wheel not covered by the upper cover. The lower cover is made of a thicker plate material than the upper cover, and guide plates for the hand chain are integrally disposed at both right and left ends. The right and left ends of the front plate of the upper cover and the upper right and left ends of the lower cover are combined, and this combined portion is fixed to the side plate of the chain block by a common bolt, while the intermediate portion of the lower cover is affixed to the side plate by another bolt.

Such structures are, however, not completely satisfactory, having the problems discussed below. Further improvements have been requested.

In the disclosure of the Japanese Utility Model Publication No. 48-19725, the structure for mounting the hand chain wheel guide plate itself is relatively simple, but, at the time of mounting, engagement of the positioning dowel and small hole is difficult, and the assembling efficiency is very poor.

Also since the guide portion of the hand chain guide plate is located in the upper edge of the hand chain wheel cover, the entire side portion of the hand chain wheel is open, and the hand chain is exposed to the outside. Accordingly, there was possibility of touching the hand chain wheel portion by hand or catching of a falling object through this open portion, which is not desirable for safety reasons.

In the structure disclosed in Japanese Utility Model Publication No. 49-36204, the guide plate for guiding the hand chain is a small piece disposed at right and left end portions of the lower cover such that nearly the entire side portion of the hand chain wheel is open, which poses safety problems.

Also, the lower hand chain wheel cover is relatively thick, and further reduction of weight is desired, but when made thin, the strength may be lowered.

In both cases, furthermore, when the hand chain is pulled and operated at a relatively high speed, for example, in the case of operation when no load is suspended on the load chain, twist (entangling) of the hand chain may not be completely cleared to the original state by the hand chain guide plate. Accordingly, the hand chain is taken up on the hand chain wheel in a twisted state, and smooth hand chain operation is impeded.

BRIEF SUMMARY OF THE INVENTION

It is hence a primary object of the invention to present a novel hand-operated chain block in the light of the above problems in the prior art.

It is another object of the invention to present a hand-operated chain block with a hand chain portion having a safe construction, and is also lightweight and simplified, and is capable of assuring smooth hand chain operation.

It is another object of the invention to present a hand-operated chain block capable of using an existing cover mounting stay for mounting the hand chain wheel directly, so as to simplify and reduce the weight of the chain block structure, and also enhancing productivity, and lowering manufacturing cost and product cost by simplifying assembly.

It is another object of the invention to present a hand-operated chain block, wherein the hand chain guide cover is a one-piece object folded and formed from a metal plate and is therefore extremely lightweight and simple in structure, and therefore a sufficient strength is provided without increasing the weight of the entire chain block, but actually reducing the weight.

It is a still a further object of the invention to present a hand-operated chain block completely free from dislocation or twisting of the hand chain, and touching by hand and entangling with falling object of the hand chain wheel portion, so as to be extremely high in safety.

It is another object of the invention to present a hand-operated chain block wherein the upper end of the dropping portion of the hand chain guide cover is supported as being suspended by a pair of stays in the upper part, the middle of the bottom is positioned and supported by the stay in the lower middle position, hand chain insertion holes penetrating through the UP side and DOWN side of the hand chain are fixed and positioned, so that the hand chain may be pulled and operated easily and stably at any angle in lateral and longitudinal directions, regardless of the pulling force.

It is a further object of the invention to present a hand-operated chain block capable of avoiding generation of contact noise, even if the hand chain is operated obliquely, by preventing the contact of the hand chain with the hand chain wheel cover by the hand chain guide hole in the bottom.

It is a still further object of the invention to present a hand-operated chain block simple in the mounting structure of the hand chain guide cover, and excellent in the mounting job efficiency.

To achieve the above objects, the invention presents a hand-operated chain block which comprises a load sheave rotatably pivoted between a pair of side plates, a hand chain wheel disposed at the opposite side of the load sheave at one of the two side plates and mechanically coupled with the load sheave, and enclosing means to cover the entire periphery of the hand chain wheel, wherein the enclosing means comprises a hand chain wheel cover for covering the upper, lower and front parts of the hand chain wheel, a hand chain guide cover for covering both sides of the hand chain wheel and also guiding the outer circumferential side of the hand chain, and a plurality of stays for supporting these two covers, the plurality of stays are disposed around the hand chain wheel at one opposite side of the side plate, two of them are positioned above the rotary shaft of the hand chain wheel, other one is located beneath the rotary shaft of the hand chain wheel, being positioned in the middle of the interval of the above two, the hand chain guide cover is a one-piece object bent and formed out of a metal plate, comprising drooping portions for guiding the UP side and DOWN side of the hand chain and the bottom portion for communicating with the lower end of these two drooping portions, the drooping portions have upper support parts curved and formed in the upper end portions, the upper support portions are inserted and supported in upper two stays, the bottom portion has hand chain inserting holes penetrating into the UP side and DOWN side of the hand chain, and a lower support portion to be positioned and supported in one lower stay is provided in its middle portion.

These and other objects and features of the invention will be better understood and appreciated by the following detailed description and claims taken in the conjunction with the accompanying drawings.

DETAILED DESCRIPTION OF THE PREFERRED EMBODIMENT

Figure 1:
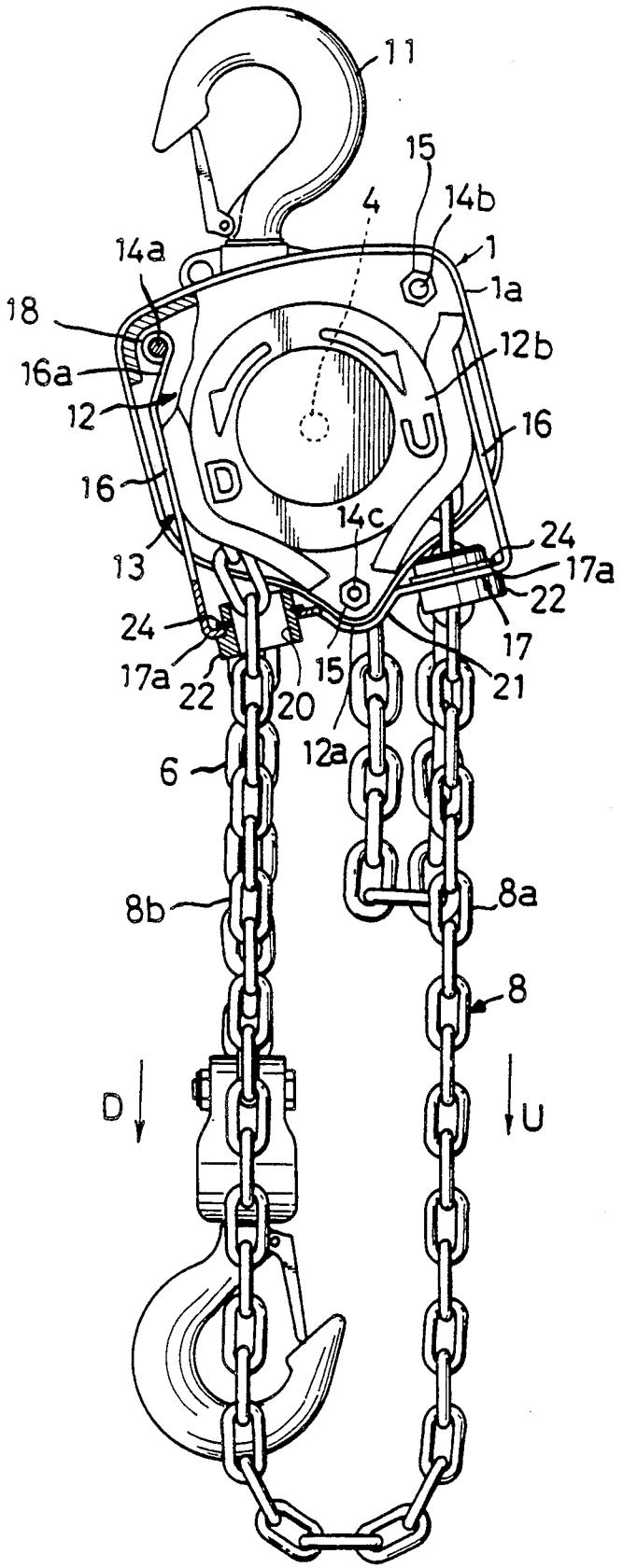
FIG. 1 is a front view, partially cut open, showing a hand-operated chain block which represents one embodiment of the invention.
Figure 2:
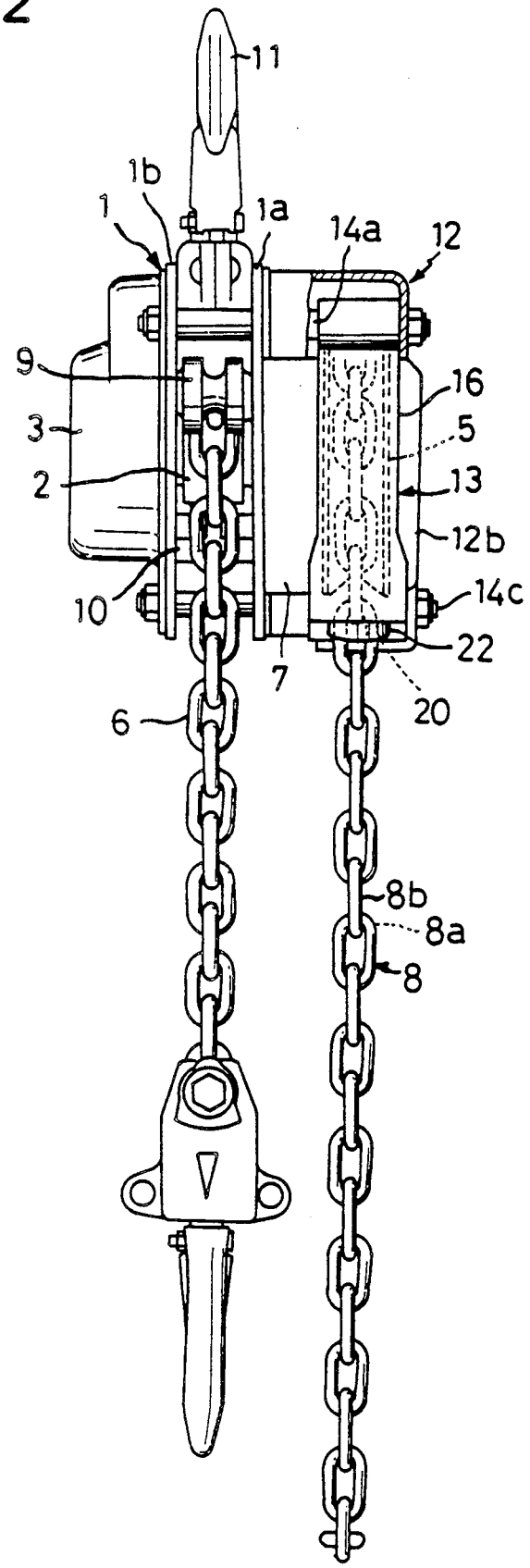
FIG. 2 is a side view, partly cut open, of the chain block.

A hand-operated chain block according to the invention is shown in FIG. 1 and FIG. 2, in which the chain block includes a chain block main body 1, load sheave 2, reduction gear mechanism 3, drive shaft 4, and a hand chain wheel 5. The load sheave 2 is rotatably mounted between front and rear side plates 1*a*, 1*b* which compose the chain block main body 1, and a load chain 6 is wound thereon. Furthermore, the load sheave 2 is coupled with the drive shaft 4 through reduction gear mechanism 3, and the drive shaft 4 is coupled with the hand chain wheel 5 through friction plate mechanism 7, and a hand chain 8 is wound on this hand chain wheel 5.

The drive shaft 4 is rotatably mounted inside the load sheave 2. The structures of other principal parts are well known in the art, and explanations of these structures are not provided herein. Numeral 9 denotes a guide for guiding the load chain 6, numeral 10 denotes a stripper for preventing entangling of the load chain 6, and numeral 11 denotes a hook for suspending the chain block main body 1.

The hand chain wheel 5 is positioned such that the entire periphery of the hand chain wheel 5 is covered by enclosing means, and the enclosing means comprises principal components such as hand chain wheel cover 12 and hand chain guide cover 13. These components of the enclosing means are extremely lightweight and simple structures as described below, and the weight of the entire chain block is reduced while maintaining a sufficient strength.

Figure 3:
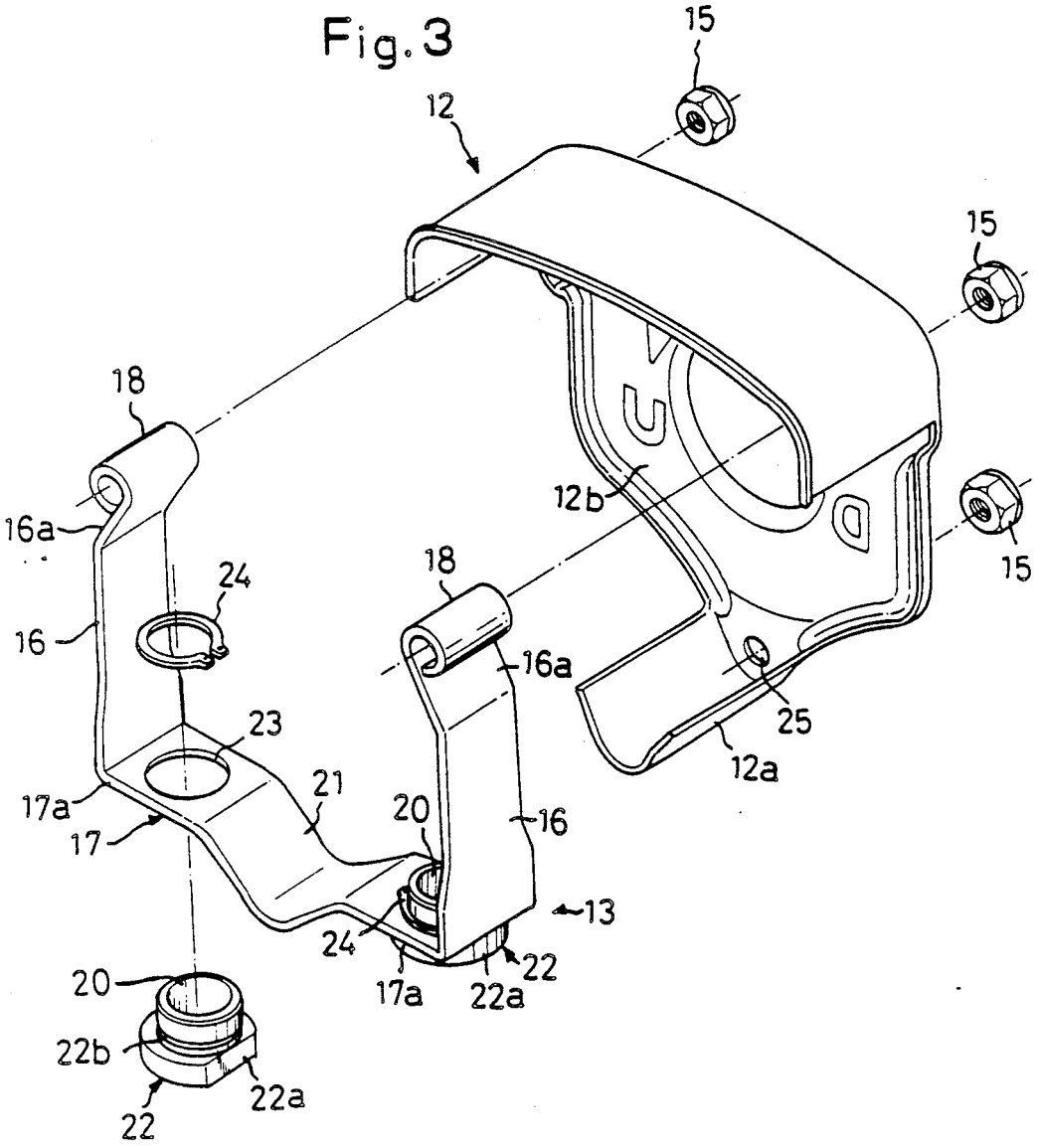
FIG. 3 is a perspective view showing a disassembled state of a hand chain guide cover and hand chain wheel cover of the chain block.

The hand chain wheel cover 12 is a one-piece member formed by pressing a metal plate as shown in FIG. 3. The hand chain wheel cover 12 is tightened by nuts 15 to three stays 14*a*, 14*b*, 14*c* disposed in the front and rear side plates 1*a*, 1*b* of the chain block main body 1, thereby covering the upper, lower and front parts of the hand chain wheel 5. Moreover, the middle part of the lower end portion of the hand chain wheel cover 12 is fixed to the stay 14*c* in the middle of the lower part, and also possesses a cover part 12*a* in an arc section, and the lower outside of the stay 14*c* is covered by this cover part 12*a*.

The three stays 14*a*, 14*b*, 14*c* are disposed around the hand chain wheel 5, and when the hand-operated chain block is suspended from above, the upper two stays 14*a*, 14*b* are positioned above the drive shaft 4, and the lower stay 14*c* is positioned in the middle of the upper stays 14*a*, 14*b*, beneath the drive shaft 4.

The hand chain guide cover 13 is suspended on the upper right and left stays 14*a*, 14*b* in its upper end portion, and is fixed in the position of the lower stay 14*c* in its lower end middle portion, so that the right, left and lower parts of the hand chain wheel 5, that is, the side openings parts of the hand chain cover 13 are covered.

The hand chain guide cover 13 is, as shown in FIG. 3, a one-piece object formed by pressing a metal plate. The right and left vertical portions 16, 16 of the hand chain guide cover 13 are drooping parts for guiding the UP side portion 8*a* and DOWN side portion 8*b* of the hand chain 8, and its horizontal portion 17 is the bottom portion for coupling the lower ends of the drooping parts 16, 16.

The upper part 16*a* of each drooping part 16 is bent inward with a slight inclination, and its upper end portion is curved outward in an arc section, thereby forming an upper support part 18. The upper support part 18 is inserted into the upper stay 14*a* or 14*b*, and therefore the hand chain guide cover 13 is suspended and supported at the rear side of the front plate part 12*b* of the hand chain wheel cover 12. In this supporting state, the upper drooping part 16 covers the outside of the hand chain 8, and acts to guide the hand chain 8 smoothly together with the hand chain insertion hole 20 discussed later.

The bottom part 17 has hand chain insertion holes 20, 20 through which the UP side portion 8*a* and DOWN side portion 8*b* of the hand chain 8 are inserted, disposed in the horizontal portions 17*a*, 17*a* at right and left sides, and the middle portion of the bottom part 17 is the lower support part 21 to be positioned and supported in the position of the lower stay 14*c*.

The hand chain insertion hole 20 is composed of a cylindrical inner surface of a cylinder 22, and the cylinder 22 is fixed to a mounting hole 23 in the horizontal portion 17*a* of the bottom part 17 by means of stop ring 24 as shown in FIG. 3. The inside diameter of the cylinder 22 is in a dimension capable of penetrating the hand chain 8, and the outside diameter is in a dimension capable of penetrating through the mounting hole 23. In the lower end of the cylinder 22, a lower flange 22*a* abutting against the lower surface of the horizontal portion 17*a* is provided, and from the upper surface of the lower flange 22*a* to the outer circumference upward by the portion of the wall thickness of the horizontal portion 17*a*, an annular fitting groove 22*b* to be engaged with the stop ring 24 is provided. After the cylinder 22 is inserted from beneath into the mounting hole 23, the stop ring 24 is fitted into the fitting groove 22*b* of the cylinder 22 projected upward from the horizontal portion 17*a*, thereby forming the hand chain inserting hole 20.

In the hand chain inserting hole 20, the UP side portion 8*a* or DOWN side portion 8*b* of the hand chain 8 wound on the hand chain wheel 5 is inserted and guided. The hand chain inserting hole 20 also acts to prevent twisting (entangling) when the hand chain 8 penetrates through the hand chain inserting hole 20, in addition to the guiding action of the hand chain 8.

The lower support part 21 is in a nearly V-shaped bent recess downward from the horizontal portions 17*a*, 17*a* at both sides, and this portion is positioned and supported in the lower portion of the cover 12*a* of the hand chain wheel cover 12. As a result, the hand chain inserting holes 20, 20 are fixed and positioned, and, as shown in FIG. 1, by pulling of the hand chain 8, even if the chain block main body 1 is inclined, the hand chain 8 is prevented from contacting with the hand chain wheel cover 12.

The mounting procedure of the enclosing means is very easy, and assembly efficiency is excellent. In the first place, after inserting the hand chain 8 into the hand chain inserting holes 20, 20 of the hand chain guide cover 13, the lower support part 21 of the hand chain guide cover 13 is positioned, corresponding to the lower position of the lower stay 14*c*, and in this state the upper support parts 18, 18 are inserted into the upper right and left stays 14*a*, 14*b*. In succession, while putting the hand chain wheel cover 12 over the hand chain wheel 5 from the front side (the right side in FIG. 2), three penetrating holes 25 through the front plate parts 12*b* are matched with the three stays 14*a*, 14*b*, 14*c*, and then nuts 15 are fastened on stays 14*a*, 14*b*, 14*c*. In this case, the cover part 12*a* of the hand chain wheel cover 12 is inserted between the lower stay 14*c* and the lower support part 21 of the hand chain guide cover 13, thereby supporting and fixing the lower support part 21.

When the UP side portion 8*a* of the hand chain 8 in is pulled the load lifting direction U, pulling force is transmitted to the load sheave 2 through the hand chain wheel 5, friction plate mechanism 7, drive shaft 4 and reduction gear mechanism 3, and hence the load sheave 2 is rotated in the hoisting direction, and the load chain 9 wound thereon is lifted up.

On the other hand, by pulling the DOWN side portion 8*b* of the hand chain 8 in the load lowering direction D, the load chain 6 is lowered in the reverse action of the above.

In this case, the hand chain 8 is guided by the hand chain guide cover 13, and smooth pulling action is assured, and twisting of the hand chain 8 is effectively prevented at the same time. The guide function of the hand chain guide cover 13 is particularly effectively exhibited in the hand chain operation without load suspended on the load chain 6.

That is, the pulling operation of the hand chain 8 when load is not suspended on the load chain 6 is done at a relatively high speed, and the upper part of the hand chain 8 tends to project outwardly by inertia (in the lateral direction in FIG. 1), but this thrusting action is prevented by hitting against the inner surface of the drooping part 16 of the hand chain guide cover 13, so that winding of hand chain 8 on the hand chain wheel 5 is done smoothly.

Besides, the portion of the hand chain 8 taken up on the hand chain wheel 5 is provided with a guide part (not shown) for restoring the twist of the hand chain 8, but when the hand chain 8 is pulled at high speed as mentioned above, the guide part alone is insufficient to fully eliminate twist. Such situation is remedied by the hand chain inserting hole 20.

More specifically, when the hand chain 8 passes through the hand chain penetrating hole 20, any twist occurring in the hand chain 8 is quickly and smoothly eliminated by the action on the cylindrical surface, and a smooth hand chain operation is guaranteed.

Besides, the upper part of the hand chain 8, that is, the portion to be wound up on the hand chain wheel 5 is covered by the hand chain guide cover 13 and is not exposed to the outside, and the risk of touching the part of the hand chain wheel 5 from this portion or entangling with a falling object is avoided, so that sufficient safety is guaranteed.

What is more, the hand chain guide cover 13 is formed by bending a metal plate, and the right and left drooping parts 16, 16 are formed into one body through the bottom part 17, while the lower support part 21 is fixed and positioned, so that the positions of the hand chain inserting holes 20, 20 are unchanged. Accordingly, when unloading a heavy load or otherwise, the pulling force of the hand chain 8 is large, or if pulling in a state largely inclined in the longitudinal or lateral direction, it is possible to operate always stably. Furthermore, since the hand chain penetrating hole 20 is designed to keep a specific distance from the hand chain wheel cover 12, even when the hand chain 8 is operated obliquely, contact of the hand chain 8 with the hand chain wheel cover 12 is prevented, and generation of contact noise is avoided.

The detailed description of the embodiment of the invention described herein is only intended to illustrate the technical aspect of the invention, and hence the invention should not be interpreted in a narrow sense limited to the foregoing embodiment along, but should be understood in a wider sense of meaning so that changes and modifications may occur as far as not departing from the true spirit and claims of the invention.

What is claimed is:

1. A hand-operated chain block, comprising:

a load sheave rotatably mounted between a pair of side plates, a hand chain wheel having an upper part, a lower part, a front part, a back part, and sides defining a diameter, the hand wheel chain being disposed at the side of one of the side plates facing away from the load sheave and mechanically coupled to the load sheave;

a hand chain wound on the hand chain wheel; and enclosing means for covering the entire periphery of the hand chain wheel;

wherein the enclosing means comprises a hand chain wheel cover for covering the upper, lower, and front parts of the hand chain wheel, a hand chain guide cover for covering the sides of the hand chain wheel and guiding the hand chain, and a plurality of stays for supporting the hand chain wheel cover and the hand chain guide cover;

at least two of the plurality stays are upper stays positioned above the axis of rotation of the hand chain wheel and one of the plurality of stays is a lower stay positioned beneath the axis of rotation of the hand chain wheel between the two upper stays, when the hand-operated chain block is suspended from above;

the hand chain guide cover comprises drooping parts having upper and lower end portions, for guiding the hand chain, and a bottom, having two side portions and a middle portion between the two side portions, for coupling the lower end portions of the two drooping parts;

the drooping parts have upper support parts curved and formed in the upper end portions, and the upper end portions are inserted inside the hand chain wheel cover and supported on the upper stays;

the bottom of the hand chain guide cover has a hand chain inserting hole at both side portions, and in the middle portion is disposed a lower support part supported on the lower stay.

2. The hand-operated chain block of claim 1, wherein the hand chain wheel cover is a one-piece body bent and formed from a metal plate, and has an upper end, a lower end, and two sides defining a width, wherein a central portion of the lower end is provided adjacent the lower stay and has a cover part for covering the bottom of the stay;

the hand chain guide cover is a one-piece body bent and formed from a metal plate, and having vertical portions and a horizontal portion, wherein the vertical portions are the drooping parts and the horizontal portion is the bottom; and the lower support part of the bottom of the hand chain guide cover is positioned and supported in the lower portion of the hand chain wheel cover.

3. A hand-operated chain block of claim 2, wherein the upper end portion of each drooping part of the hand chain guide cover is bent in an arc section to be used as the upper support part;

the hand chain inserting hole has a diameter capable of receiving the hand chain and is formed in the horizontal portion of the bottom part of the hand chain guide cover; and the middle portion of the bottom part of the hand chain guide cover is a downward recess, and the lower support part is formed therein.

4. The hand-operated chain block of claim 3, further comprising a cylinder fitted to the horizontal portion of the bottom part of the hand chain guide cover and having a hole therethrough for insertion of the hand chain;

wherein, the diameter of the hole is sufficient to receive the hand chain, and the outer diameter of the cylinder is sized to be received in a mounting hole in the horizontal portion of the bottom part of the hand chain guide cover;

a lower flange to abut against the lower surface of the horizontal portion of the hand chain guide cover is formed at the lower end of the cylinder, and an annular fitting groove for fitting a stop ring is provided in the outer surface above the upper surface of the lower flange by a portion of the wall thickness of the horizontal portion of the hand chain guide cover, and the cylinder is inserted through the mounting hole from the lower side, and is mounted on the horizontal portion of the hand chain guide cover as the stop ring is elastically fitted into the fitting groove projecting upward from the horizontal portion of the hand chain guide cover.

5. The hand-operated chain block according to claim 3, wherein the lower support part of the hand chain guide cover comprises a recess bent nearly in a V-shape downward from the horizontal portion at both sides.

* * * * *

UNITED STATES PATENT AND TRADEMARK OFFICE

CERTIFICATE OF CORRECTION

PATENT NO. : 5,125,629

DATED : June 30, 1992

INVENTOR(S) : Yosaku Nishimura

It is certified that error appears in the above-identified patent and that said Letters Patent is hereby corrected as shown below:

| COLUMN | LINE | ERROR |
|---|---|---|
| 1 | 28 | after "dowel" delete "and" |
| 2 | 47 | "dropping" should read --drooping-- |
| 5 | 48,49 | "in is pulled" should read --is pulled in-- |
| 6 | 46 | "along" should read --alone-- |
| 7 | 1 | after "plurality" insert --of-- |

Signed and Sealed this

Third Day of August, 1993

*Attest:*

Michael K. Kirk

MICHAEL K. KIRK

*Attesting Officer*

*Acting Commissioner of Patents and Trademarks*